US005820943A

United States Patent [19]

Huang

[11] Patent Number: 5,820,943

[45] Date of Patent: Oct. 13, 1998

[54] METHOD FOR IMPRINTING PATTERN ONTO BLADE OF FAN

[76] Inventor: Yu-Keng Huang, 224 Ho-Ping W. Rd. Sec. 3, Taipei, Taiwan

[21] Appl. No.: 784,301

[22] Filed: Jan. 16, 1997

[51] Int. Cl.[6] ..... B05D 1/28; B05D 1/38; B05D 5/06

[52] U.S. Cl. ..... 427/510; 427/511; 427/265; 427/267; 101/450.1

[58] Field of Search ..... 427/262, 265, 427/267, 274, 379, 493, 487, 510, 511; 101/492, 450.1

[56] References Cited

U.S. PATENT DOCUMENTS

| | | | |
|---|---|---|---|
| 3,363,956 | 1/1968 | Vingren et al. | 427/274 |
| 3,810,774 | 5/1974 | Pittman | 427/262 |
| 3,991,484 | 11/1976 | Lamb et al. | 34/162 |
| 4,105,806 | 8/1978 | Watt | 427/511 |
| 4,439,480 | 3/1984 | Sachs et al. | 428/161 |
| 4,486,033 | 12/1984 | Parrotta | 283/94 |
| 5,425,970 | 6/1995 | Lahrmann et al. | 427/493 |

FOREIGN PATENT DOCUMENTS 4033104 4/1992 Germany .

*Primary Examiner*—Shrive Beck
*Assistant Examiner*—Fred J. Parker
*Attorney, Agent, or Firm*—Beveridge, DeGrandi, Weilacher & Young, LLP

[57] ABSTRACT

A method for imprinting a pattern onto a blade of a fan includes the steps of 1) forming a blade with thermoplastic material by injection-molded; 2) coating an ink layer of wooden pattern onto the blade made from step 1) with a suitable printing device at room temperature; 3) drying the ink layer on the blades with infrared radiation during the transferring; 4) coating a protecting layer onto the ink layer with a suitable printing device at room temperature; 6) drying the clear UV layer at room temperature and then further drying the clear UV layer with ultraviolet radiation in a dryer such that the ink layer and said clear UV layer are polymerized with each other until the clear UV layer is completely cured and hardened.

7 Claims, 4 Drawing Sheets

METHOD FOR IMPRINTING PATTERN ONTO BLADE OF FAN

FIELD OF THE INVENTION

The present invention relates to a method for imprinting a pattern onto a blade of a fan, more particularly, this method can be performed by an apparatus wherein both surfaces of the blade can be imprinted with a high quality of pattern.

DESCRIPTION OF PRIOR ART

Fans have been widely used in our daily life for cooling or ventilation, especially in summer days. Normally, the fan includes a motor having a plurality of blades disposed on the output shaft of the motor. When the motor is turned on, the blades are rotated to propel the air to circulate, consequently, cooling or ventilating effect can therefore be attained. Besides, a fan may also serve as a decoration in addition to its traditional functions, for example, a ceiling fan. Not only will this fan provide cooling and ventilating effect, but it will also provide a decorating effect to a living room. As a matter of fact, the present invention directs to this kind of fan, hereinafter referred to as a hanging fan. As this hanging fan is also a benchmark of the living standard, and as our living standard grows up, the market of this hanging fan will also increase.

In order to increase the aesthetic appearance of the blades of the hanging fan which are normally made from a metal sheet or injection molded from thermoplastic material, a layer of pattern or designed figure can be coated or attached to the outer surfaces of the blades. Normally, a wooden layer which bears natural patterns is adhered to the outer surfaces of the blades to increase the quality level of the blades. Normally, this hanging fan has four blades which have comparatively larger surface area and thus it needs many wooden layers to cover it. Consequently, this negatively impacts the environment since the speed of cutting woods is always faster than the growth of plants. The resource of wooden layers therefore is limited as the concerns of environment protection grow. By the way, in order to increase an expressive appearance, the blades are inherited with chamfered, curved and waved or even a specially designed configurations ( in the preferred embodiment of the present, a sheet of traditional Chinese medicine ) which bring difficulty in attaching the wooden layer to the outer surfaces of the blades. In the later cases, the wooden layer shall be attached or adhered to the outer surfaces manually which costs a great deal of time to attain a neat, beautiful product. Nevertheless, this manual production suffers from poor throughput. By the way, the wooden layer attached to the blades can be readily effected by the environmental factors, such as the humidity, wearing, adhesive, consequently, deforming, bulking and depriving are always found in the wooden layer.

SUMMARY OF THE INVENTION

It is the object of this invention to provide a method for imprinting a pattern onto a blade of a fan wherein the surfaces of the blades can be imprinted with an aesthetic pattern which is permanently attached thereto without depriving and deforming thereof. Consequently, the cutting of wood can be prevented and the natural resource can be therefore protected.

It is still the object of this invention to provide a method for imprinting a pattern onto a blade of a fan wherein the ink layer and clear UV painting layer are specially coated to bring a wooden pattern on the surfaces of the blades.

In order to achieve the object set forth, the method for imprinting a pattern onto a blade of a fan includes the steps of 1) forming a blade with thermoplastic material by injection-molding; 2) coating an ink layer of wooden pattern onto the blade made from step 1) with a suitable printing device at room temperature; 3) drying the ink layer on the blades with infrared radiation; 4) coating a protecting layer onto said ink layer with suitable printing device at room temperature; 6) drying the clear UV layer at room temperature and then further drying the clear UV layer with ultraviolet radiation in a dryer such that the ink layer and said clear UV layer are polymerized with each other till the clear UV layer is completed cured and hardened.

In one preferred embodiment of the present invention, the printing can be a roller transfer printing or a lithography.

In one embodiment of the present invention, the room temperature is around 25 degrees Celsius.

In one embodiment of the present invention, the thickness of the clear UV layer is about 0.4 to 0.6 mm.

In one embodiment of the present invention, the ultraviolet radiation is generated by a lamp with pressurized mercury vapor and the distance between the lamp and surfaces of blade is about 20 centimeters.

In one embodiment of the present invention, the temperature within the dryer is about 60 to 80 degrees Celsius such that the surface of the blades can be heated to 35 degrees Celsius.

By the manufacturing procedures described, the outer surfaces can be imprinted with an aesthetic pattern of wooden or other suitable patterns or designs.

BRIEF DESCRIPTION OF THE DRAWINGS

In order that the present invention may more readily be understood the following description is given, merely by way of example with reference to the accompanying drawings, in which.

BRIEF DESCRIPTION OF NUMERALS

Figure 1:
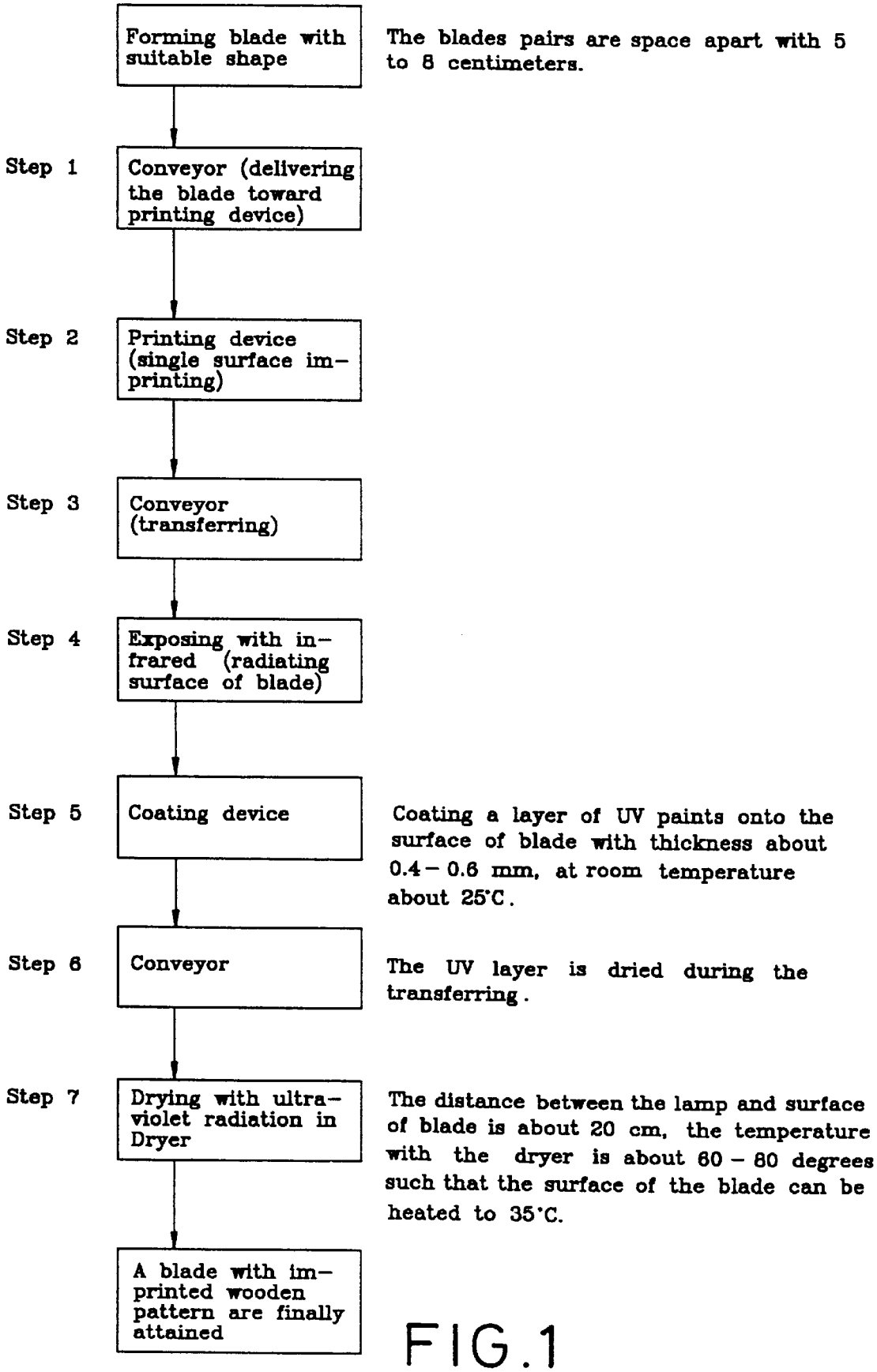
FIG. 1 is a flow diagram of the manufacturing process provided according to he present invention.

10 printing device 11 plate cylinder
12 cylinder 13 paints inlet
20 blade 30 supporting rollers
31 recycling tray 40 dryer
41 lamp

DETAILED DESCRIPTION OF PREFERRED EMBODIMENT

Figure 2:
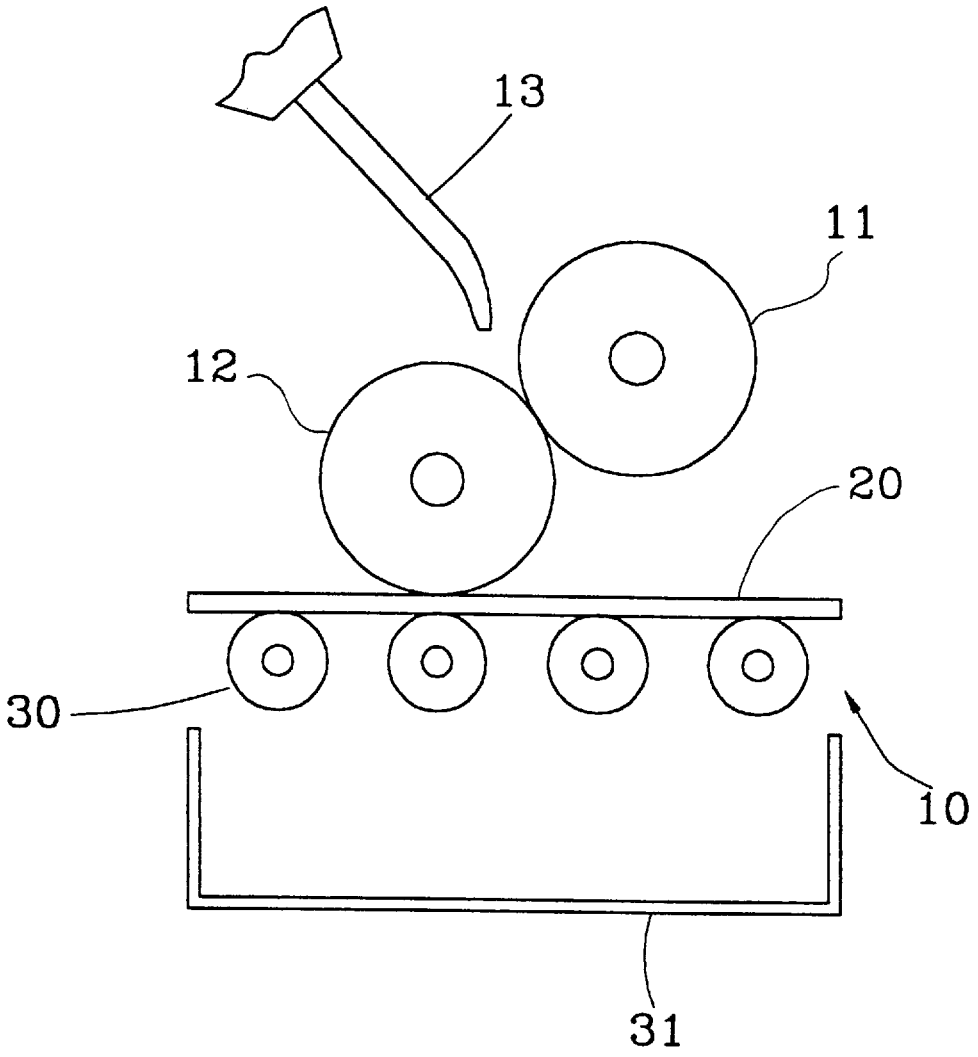
FIG. 2 is a schematic illustration of a printing device incorporated in the process described in FIG. 1.

Referring to FIGS. 1 and 2, the blade 20 of the fan made according to this invention is injected molded from the material family selected from ABS (acrylonitrile butadiene styrene), AS (acrylonitrile styrene) , PH-88, PS, acrylic and other suitably polymer. The blade 20 can be made to any suitable shape. When the blade 20 is formed and cured, it is treated with the following processes.

1) delivering the blade pairs along a transfer conveyor to a printing device wherein the blade pairs are spaced about 5 to 8 cm;

2) Imprinting a layer of wooden pattern onto the upper surface of the blade 20 with the printing device 10, as best shown in FIG. 2. The printing device 10 generally includes a plate cylinder 11 and a cylinder 12 in operatively aligned relationship with each other. The plate cylinder 11 is made from copper etching with a preselected pattern and is further plated with stainless. The PVC ink is pumped and regulated and is supplied through an inlet 13 to the position between the plate cylinder 11 and cylinder 12 in a metered manner. When the plate cylinder 11 and cylinder 12 are rotated, the upper surface of the blade 20 is then imprinted with a layer of wooden pattern transferred from the plate cylinder 11. Consequently, the upper surface is incorporated with a layer of wooden pattern layer.

The printing is performed at the following conditions, i.e. (1) room temperature: about 25 degrees Celsius, (2) the plate cylinder 11 and the cylinder 12 are specially arranged such that those two cylinders are slightly contacted; (3) the excess ink is directed to flow back to recycling tray 31 through the clearance between the supporting rollers 30; and 4) the ink can be readily adjusted with thinner agent to achieve suitable colors and viscosity. Besides, the plate cylinder 11, cylinder 12 and supporting rollers 30 are also cleaned with the thinner agent.

3) When the ink is dried, the blades pair are delivered again;

4) The blades pair are further treated with ultraviolet radiation to completely get the ink dried and cured;

5) The dried and cured blades pair are further coated with a layer of clear UV layer onto the ink layer in a coating device. The coating device has a similar or identical configuration of the printing device and the clear UV layer can be readily transferred to the ink layer by the cooperation of a plate and cylinders.

The clear UV layer is coated with the following conditions, i.e. 1) the thickness of clear UV layer is about 0.4 to 0.6 mm; and 2) the coating is performed at room temperature: 25 degrees Celsius.

6) The resulted blades pair are further transferred to a dryer and are also dried at room temperature during the transferring; and 7) The blades pair are further treated within the dryer with ultraviolet radiation such that the ink layer and said clear UV layer are polymerized with each other till the clear UV layer is completely cured and hardened.

The ultraviolet radiation exposed to the clear UV layer and ink layer are generated by a lamp incorporated with pressurized mercury vapor. Accordingly, the ink and clear UV layers can be completely cured and hardened.

Figure 3:
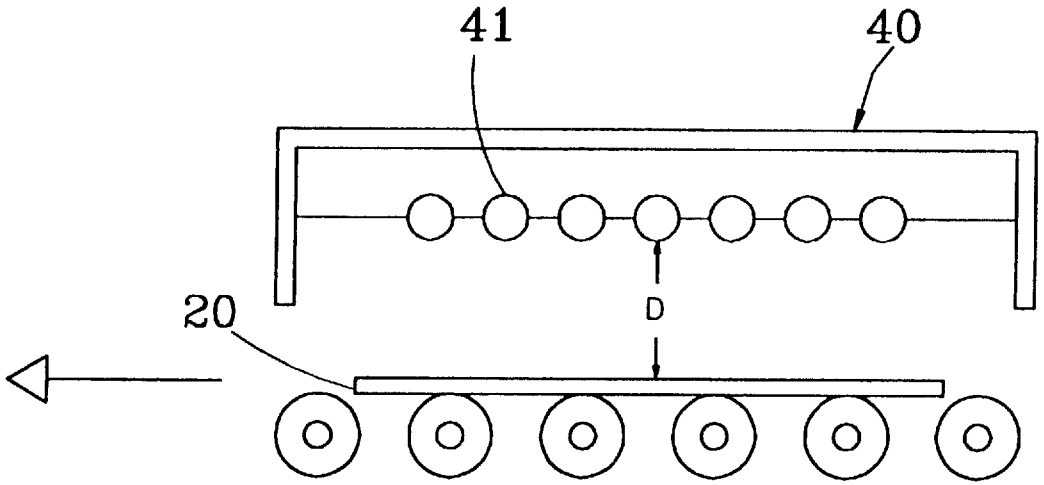
FIG. 3 is still a schematic illustration showing the relative relationship between the ultraviolet light and the surface of the blades.
Figure 4:
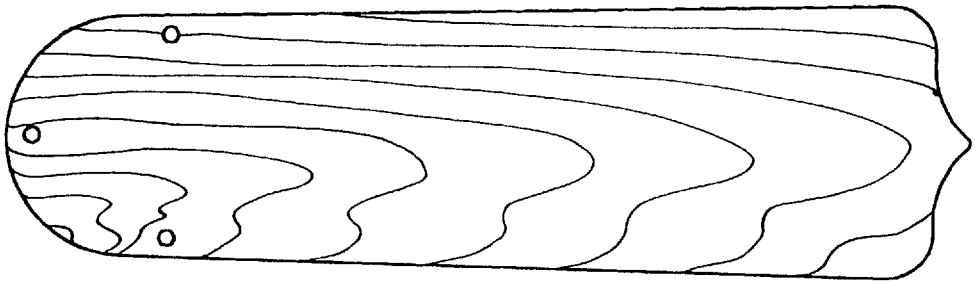
FIG. 4 is a schematic illustration of the blade after it is treated with the processes provided by the present invention.

As shown in FIG. 3, the lamp 41 in the dryer 40 is about 5 kW and the distance (D) between the lamp 41 and the surface of blade 20 is about twenty (20) centimeters. The temperature within the dryer is about 60 to 80 degrees Celsius such that the surface of the blades can be heated to 35 degrees Celsius.

When the first or upper surface of the blades are imprinted with wooden patterns, the second or bottom surface can be converted and treated with the same processes to get the same result.

By the forgoing description of the present invention, the blades of a hanging fan can be readily imprinted with a wooden patterns or other suitable designs or figures with the processes described above. Furthermore, each and every blade can be imprinted with high quality printed image quickly and efficiently. Since the ink and clear UV layers are polymerized, it will not readily deprive therefrom. On the other hand, a smooth and flat surface can be attained with the processes described above. Apparently, the problem and its side effect encountered by the prior art can be completely solved.

The wooden patterns and the clear UV layer can be imprinted to the surfaces of the blades with heated roller transfer printing and/or lithography. Nevertheless, the wooden patterns can also be imprinted by the lithography process. On the other hand, the clear UV layer can also be imprinted with showing bath to attain the same result.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A method for imprinting a pattern onto a blade of a fan, comprising the steps of:

coating the blade with an ink layer in a wood grain pattern;

drying said ink layer with infrared radiation;

coating a protecting layer onto said dried ink layer;

drying said protecting layer at room temperature; and polymerizing said dried ink dried and protecting layers with each other by treating said ink and protective layers with ultraviolet radiation until said protecting layer is cured and hardened.

2. The method as recited in claim 1, wherein said protecting layer is a layer of UV paint for protecting said ink layer.

3. The method as recited in claim 1, wherein the ink layer is coated on the blade by roller transfer printing at room temperature and the thickness of the ink layer is about 0.4 to 0.6 millimeters.

4. The method as recited in claim 1, wherein the ink layer is coated on the blade by lithography printing and the thickness of the layer is about 0.4 to 0.6 millimeters.

5. The method as recited in claim 2, wherein the UV layer is coated on the ink layer by heated roller transfer printing and the thickness of the UV layer is about 0.4 to 0.6 millimeters.

6. The method as recited in claim 2, wherein the thickness of the layer of UV paint is about 0.4 to 0.6 millimeters.

7. The method as recited in claim 1, wherein the ultraviolet radiation of the dryer is generated by a lamp with pressurized mercury vapor and the distance between the lamp and the blade is about 20 centimeters, and temperature within the dryer is about 60 to 80 degrees Celsius.

* * * * *